US011287236B1

(12) United States Patent
Dindl et al.

(10) Patent No.: US 11,287,236 B1
(45) Date of Patent: Mar. 29, 2022

(54) TRAINING CARTRIDGE WITH DAY/NIGHT/THERMAL VISIBLE SIGNATURE

(71) Applicants: Frank Dindl, Newton, NJ (US); Kenneth R Jones, Rockaway, NJ (US)

(72) Inventors: Frank Dindl, Newton, NJ (US); Kenneth R Jones, Rockaway, NJ (US)

( * ) Notice: Subject to any disclaimer, the term of this patent is extended or adjusted under 35 U.S.C. 154(b) by 0 days.

(21) Appl. No.: 17/089,006

(22) Filed: Nov. 4, 2020

(51) Int. Cl.
*F42B 12/40* (2006.01)
*F42B 8/04* (2006.01)
*F42B 8/02* (2006.01)

(52) U.S. Cl.
CPC ..... *F42B 12/40* (2013.01); *F42B 8/02* (2013.01); *F42B 8/04* (2013.01)

(58) Field of Classification Search
CPC ..... F42B 12/40; F42B 12/44; F42B 12/50
See application file for complete search history.

(56) References Cited

U.S. PATENT DOCUMENTS 684,653 A * 10/1901 Tubini ..... F42C 1/04 102/513
694,032 A * 2/1902 Semple ..... F42B 12/38 102/513
708,411 A * 9/1902 Semple ..... F42B 12/38 102/513
1,394,335 A * 10/1921 Nichols ..... F42B 12/42 102/513
1,451,395 A * 4/1923 Hustvedt ..... F42B 12/40 102/513
1,518,247 A * 12/1924 Brayton ..... F42B 12/38 102/513
2,786,415 A * 3/1957 Alderson ..... F42B 8/10 42/77
2,892,400 A * 6/1959 Zaharakis ..... F42B 12/36 102/529
3,064,577 A * 11/1962 Brandt ..... F42B 8/18 102/529
3,101,054 A * 8/1963 Stevenson ..... F42B 12/38 102/210
3,289,589 A * 12/1966 Hitchens ..... F42B 12/40 102/513
3,291,049 A * 12/1966 Hitchens ..... F42B 12/40 102/513
3,374,741 A * 3/1968 Bass ..... F42B 12/38 102/513
3,434,420 A * 3/1969 Ciccone ..... F42B 12/50 102/499
3,528,662 A * 9/1970 Engle ..... F42B 12/40 473/577
3,645,208 A 2/1972 Weinssen et al.
3,677,182 A * 7/1972 Peterson ..... F42B 12/50 102/505
3,707,918 A * 1/1973 Dunfee ..... F42B 12/50 102/370

(Continued)

*Primary Examiner* — Derrick R Morgan
(74) *Attorney, Agent, or Firm* — Baldini Law, LLC

(57) ABSTRACT

The present disclosure is directed to ammunition rounds for training purposes. Specifically, the training munitions disclosed herein contain special properties rendering them visible by day, by night and through the use of thermal imagery while maintaining safety protocols and otherwise normal usage properties without requiring the outer shell to deform or destruct to initiate the signal properties.

13 Claims, 16 Drawing Sheets

(56) References Cited

U.S. PATENT DOCUMENTS 3,713,394 A * 1/1973 Dare ..... F42B 30/06 42/105
3,732,821 A * 5/1973 Royer ..... F42B 8/02 102/512
3,810,426 A * 5/1974 Baker ..... F42B 12/42 102/513
3,811,381 A * 5/1974 Fichter, Jr. ..... F42B 12/48 102/513
3,983,817 A * 10/1976 Tucker ..... F42B 12/50 102/513
4,044,684 A * 8/1977 Gaggini ..... F42B 12/50 102/370
4,227,460 A * 10/1980 Krone ..... F42B 12/48 102/513
4,488,490 A * 12/1984 Betts ..... F42C 1/10 102/513
4,699,061 A * 10/1987 Jeffers ..... F42B 12/50 102/478
6,250,226 B1 * 6/2001 Leichter ..... F42B 12/50 102/370
6,523,478 B1 * 2/2003 Gonzalez ..... F42B 30/04 42/105
8,025,011 B1 9/2011 Yafai et al.
8,297,187 B2 * 10/2012 Sullivan ..... F42B 12/40 102/370
8,424,456 B2 * 4/2013 Broden ..... F42B 8/14 102/444
8,640,621 B2 2/2014 Broden et al.
8,783,186 B2 7/2014 Scanlon et al.
8,813,652 B2 * 8/2014 Shin ..... F42B 12/48 102/513
8,881,655 B2 * 11/2014 Aw ..... F42B 12/40 102/512
9,217,627 B2 12/2015 Sullivan et al.
9,958,242 B2 * 5/2018 Sullivan ..... F42B 12/50
10,408,590 B1 9/2019 Campagnuolo et al.
10,845,172 B2 * 11/2020 Moreno ..... F42B 8/16
2011/0079164 A1 * 4/2011 Broden ..... F42B 8/12 102/444
2011/0252995 A1 * 10/2011 Dindl ..... F42B 10/48 102/517
2015/0083012 A1 * 3/2015 Mutascio ..... F42B 12/38 102/513
2018/0156590 A1 * 6/2018 Reuther ..... F42B 12/382
2020/0109928 A1 * 4/2020 Omonira ..... F42B 12/36

* cited by examiner

TRAINING CARTRIDGE WITH DAY/NIGHT/THERMAL VISIBLE SIGNATURE

FIELD OF THE INVENTION

The present disclosure is directed to ammunition rounds for training purposes. Specifically, the training munitions disclosed herein contain special properties rendering them visible by day, by night and through the use of thermal imagery while maintaining safety protocols and otherwise normal usage properties without requiring the outer shell to deform or destruct to initiate the signal properties.

BACKGROUND

There is a great need for safe, but otherwise normally deployed munitions rounds, for training purposes. It is a significant benefit for such rounds to be capable of daytime visibility, nighttime visibility, tracking through thermal imagery, and still maintain generally normal properties such as not deforming upon impact, or needing to deform in some manner in order to activate the visibility mechanism. Other approaches have been to design a projectile that survives launch, but breaks open upon impact to release some type of signature creating signal. Alternatively, the prior art includes having an internal chamber that breaks upon spinning within the chamber to mix signal producing compounds. The problems have been though, that in designing a cartridge intended to break open, whether upon impact or some internal chamber upon firing, it can break open at inopportune times, such as simply by dropping it. Depending on the actual mechanism that creates the signal, this can be anything from messy to dangerous.

It would be advantageous to have a practice training round that comprises a non-hazardous dud that comprises a flash mechanism providing a bright, short duration flash capable of visibility without rupture of the outer shell, utilizing the hot gases that are produced in generating the flash to vent into a separate area of the projectile to mix with a signature powder material that is then expelled through a vent hole simulating the smoke of an explosion of a combat round, wherein such exhausted gases and by-products are relatively low temperature and low hazard, minimizing the risk of range fires or hazardous duds. It would further the advantageous design if the practice training round that comprises a non-hazardous dud was designed to survive launch and target impact without breaking.

Examples of prior mechanisms in this area include, U.S. Pat. No. 8,297,187 titled IMPACT LOCATING DAY AND NIGHT MARKER FOR A PROJECTILE discloses, "a marking projectile compris[ing] separate compartments that break during launch due to rotation of the projectile as it leaves the barrel of a weapon. Metal pellets contained within the compartments are pressed outward and pierce the compartment walls. This allows for mixing of chemical materials contained within the compartments, so that the materials substantially react by the time the projectile strikes a target. The chemical materials may be a pair of chemi-luminescent components, or components that create heat for thermal marking."

In another example, U.S. Pat. No. 8,424,456 titled NON-DUD SIGNATURE TRAINING CARTRIDGE AND PROJECTILE discloses, "a training cartridge projectile for use in either a plastic cartridge case or a conventional metal cartridge case is disclosed that contains no explosive material. The projectile has an insert having a body portion and a front end, a container overmolded onto the body portion of the insert, a frangible ogive fastened to the front end of the tubular insert; and a payload module within the ogive in front of the container carrying a non-explosive signature material for providing a visual indication of projectile impact to an observer upon projectile impact with an object. The module includes a hollow frangible ampoule containing the signature material, and a generally disc shaped base member engaging the insert and closing the ampoule. The base member preferably has a set of axially extending vanes engaging the signature material during spin-up as the projectile is accelerated through the bore of the weapon firing the projectile."

In another related example, U.S. Pat. No. 8,640,621 titled NON-DUD SIGNATURE TRAINING CARTRIDGE AND PROJECTILE discloses, "a training cartridge projectile for use in either a plastic cartridge case or a conventional metal cartridge case is disclosed that contains no explosive material. The projectile has an insert having a body portion and a front end, a container overmolded onto the body portion of the insert, a frangible ogive fastened to the front end of the tubular insert; and a payload module within the ogive in front of the container carrying a non-explosive signature material for providing a visual indication of projectile impact to an observer upon projectile impact with an object. The module includes a hollow frangible ampoule containing the signature material, and a generally disc shaped base member engaging the insert and closing the ampoule. The base member preferably has a set of axially extending vanes engaging the signature material during spin-up as the projectile is accelerated through the bore of the weapon firing the projectile."

In another example, U.S. Pat. No. 8,783,186 titled, USE OF PYROPHORIC PAYLOAD MATERIAL IN AMMUNITION TRAINING ROUNDS discloses, "munitions employed for training and tactical purposes. Specifically, the present invention relates to munitions (e.g., training rounds) used with various weapons (e.g., grenade launchers), wherein each training round includes a projectile that contains a pyrophoric payload that is released into the environment and reacts with air, upon impact of the projectile with an impact site. The reaction of the pyrophoric payload with air creates a signal that can be observed from a distance, thereby marking the landing or impact site of the projectile after it has been fired from a weapon."

In another example, U.S. Pat. No. 9,217,627 titled TRAINING AMMUNITION CARTRIDGE WITH REACTIVE LIQUID MATERIALS FOR MARKING A POINT OF IMPACT discloses, a "a practice ammunition projectile ha[ving] a projectile head with one or more sheets of plastic material, each having a plurality of frangible "bubble shaped" compartments containing liquid chemical components for optical and/or Infrared marking of a target upon impact. The sheets are preferably flexible sheets in the nature of a "bubble wrap" of the type used as padding for packaging. These so-called "matrix packages" are installed adjacent the inner surface of the shell forming the projectile head and provide stability when the compartments break up upon setback when the projectile is fired from a weapon."

In another example, U.S. Pat. No. 10,408,590 titled FLASH OUTPUT FOR PROJECTILE TRAINING discloses, "an ammunition training round having a crushable nose section, a flash system which makes an impact more visible to the user in the air or on land when the round hits a ground target. In place of a fuze ignition, the flash system utilizes incendiary energetic pellets comprising ignition pellets which burst in flames when impacted. The round may also have a nose area with a lower portion plastic plug and an upper portion fuze ogive containing the ignition pellets so that when the round impacts the ground at an angle, the upper portion of the nose area snaps off and exposes its ignition pellets to ignite from the impact."

In another example, U.S. Pat. No. 8,025,011 titled STUN GRENADE discloses, "a stun grenade includes a housing having at least a portion that is not opaque; a light output section disposed in the housing, the light output section comprising a pyrotechnic material; a fuze coupled to the housing, the fuze including a time delay column inserted into the housing; and a noise output section comprising a lower portion of the time delay column and a pyrotechnic material disposed in the lower portion of the time delay column. The light output section and the noise output section are initiated at different times."

Finally, in U.S. Pat. No. 3,645,208 titled FUZELESS TARGET PRACTICE CARTRIDGE discloses, "a fuzeless target practice cartridge to produce a flash and smoke signal, upon impact of the projectile with the target. This is accomplished by the use of a controllably sensitized pyrotechnic composition, reactive on impact or abrasion, and an ogive-anvil-spike configuration designed to easily rupture upon a low-force impact. The system is made functional by a proper balancing of the sensitivity of the composition and the design of the ogive-anvil-spike configuration depending on the impact force available." Even here, where the thought is to produce a flash and smoke signal, it is required to rupture to see. There is no translucent ogive, nor is there a plugged vent portal to release the 'smoke.' And, here, the smoke is not separate and distinct from the flash allowing greater control over the signature of the signal."

Thus, there have been many attempts to provide solutions for practice munitions rounds that provide easy marking enabling observers to see impact results for training purposes. However, there are deficiencies in the prior art in that none of the foregoing solutions provide a signature that is visible day or night using the naked eye, night vision equipment, and/or thermal imagers, and that also do not involve the projectile deforming significantly in some manner. Because the prior art methods all require some sort of shell breakage or deformation, they by definition do not act and work like true munitions rounds as they impact their target and are inferior training tools. Moreover, some or all of the foregoing references provide solutions that are inconsistent and do not dependably provide the result they are intended to provide. Thus, it is an object of the current disclosure to provide a non-hazardous dud producing training round that provides a dependable, consistent, signature that is visible day or night using the naked eye, night vision equipment, and/or thermal imagers, that acts and reacts and appears as if it were a regular munition round. It is a further object of the current disclosure to eliminate the hazardous duds and the inconsistency of typical currently employed training cartridges.

In particular, the current disclosure is directed to a training round that produces non-hazardous duds comprising a flash cavity within a transparent or translucent (but still relatively rigid and strong) projectile body that produces a short duration bright flash upon projectile impact. In one embodiment, the flash producing mechanism also generates hot, pressurized gases, that rupture a seal and vent into a cavity in the rear of the projectile containing a powdered signature material wherein, the hot gases then mix with powdered signature material and ruptures or opens a vent in the base of the projectile to vent the powdered material mixed with gas that is now reduced in temperature, to the environment and create the appearance of smoke from a typical impact or a regular round. In this embodiment, the bright flash, hot gases, and powdered signature material simulate the signature of an actual live combat cartridge, with a reduced noise signature, in a non-hazardous dud round that maintains integrity upon both launch and target impact.

In one embodiment, the flash material consists of a fuel such as magnesium powder or magnesium wool, and an oxidizer such as gaseous oxygen or potassium perchlorate. In this embodiment, an ignition mechanism, such as a piece of flint striking a piece of sandpaper or rough steel surface, creates an internal cavity spark igniting the magnesium/oxidizer combination which initiates the flash immediately upon projectile impact (mimicking the flash of a live combat cartridge upon impact). In this embodiment, this flash ignition creates hot gasses within the internal chamber that then creates an internal pressure forcing open a seal plug and venting a powdered signature material, such as talc or titanium dioxide powder, that mimics the explosion smoke of an actual live combat cartridge. The outer walls of the round remain intact and perform as would any regular live round, with just a portion of what would be steel or aluminum or other metal wall replaced with polycarbonate or other rigid translucent material such that the flash is visible and a seal with a plug that ruptures just one specific point to allow the escape of smoke mimicking powder with the buildup of the hot gaseous flash pressure.

None of the foregoing references, alone or in combination, teach the salient and proprietary features of the present disclosure. None suggest a transparent or translucent projectile body portion in combination with a flash cavity and flash producing mechanism that produces a short duration bright flash upon projectile impact without rupture of the shell casing and that then further expels a smoke-like powdered signature material that mimics the explosion of a live cartridge visible to the naked eye during the day.

The present disclosure teaches several embodiments of a training cartridge designed to modify actual live combat cartridges in exact specification to fit and work with the applicable weapon, by replacing the metal projectile nose or portion of the side walls with a translucent material designed to be acceptably rigid and strong, such as polycarbonate, and further modify the internal structure to comprise a flash cavity that activates upon impact without outer shell destruction or deformation, and further producing pressure buildup inside the cavity that ejects a puff of hot gas releasing a signature powder material that ultimately produces a flash of light and signature smoke that mimics an actual live cartridge that it replaces upon impact. In one embodiment, there is a heat signature, a flash component, and a smoke component, that all look, feel, and react like a true live round visible during the day and at night with the naked eye, as well as through night thermal imaging equipment.

SUMMARY

The present disclosure teaches embodiments of a proprietary training cartridge that provides a realistic signature that is visible day or night using the naked eye, night vision equipment, and/or thermal imagers. This proprietary training cartridge looks and acts like the real live munition round and is easily handled with the same care as regular live rounds. The signature produced mimics that of a regular live round and no breakage or destruction of the outer shell is required to be deployed.

The present disclosure provides an embodiment of a proprietary training ammunition round comprising:

a training cartridge casing identical to a combat cartridge casing of an ammunition round it is designed to replace for training, comprising a primer and a propellant charge;

a projectile body comprising a first base end that is configured to seat within the training cartridge casing and a second opposite front end configured to be at least partially translucent and comprise a first and second cavity;

said first cavity containing a combustible flash producing material, an oxidizer, and a first spark producing component, said second cavity containing a predetermined amount of a signature powder material, an external vent hole and an external vent hole plug, wherein there is a solid area between said first cavity and said second cavity comprising at least one internal vent hole, and a second spark producing component capable of producing a spark when meeting with the first spark producing component housed in a compartment exposed to the first cavity and covered with a seal;

configured to produce a spark upon the second spark producing component breaking said seal and striking said first spark producing component and igniting the combustible flash producing material whereupon a flash occurs and a hot gaseous pressure builds up to a pre-determined pressure within the first cavity sufficient to break any remaining seal and causing the hot gases to leak into said second cavity through said at least one internal vent holes and mix with the signature powder material, and building up enough pressure to expel the external vent plug and causing exhaustion of the contents through the external vent hole.

In an alternative embodiment, said proprietary training ammunition round may be modified wherein:

said first cavity containing a combustible flash producing material, an oxidizer, and a first spark producing component, said second cavity containing a predetermined amount of a signature powder material, an external vent hole and an external vent hole plug, wherein there is a solid area between said first cavity and said second cavity comprising at least one internal vent hole, and a second spark producing component capable of producing a spark when meeting with the first spark producing component housed in a compartment separated from said first cavity along a hollow pathway covered with a seal and blocked by a spring actuated slider bar comprising a channel configured to align with said hollow pathway when sufficient force is generated to compress the spring;

configured to produce a spark upon the second spark producing component breaking said seal and striking said first spark producing component and igniting the combustible flash producing material whereupon a flash occurs and a hot gaseous pressure builds up to a pre-determined pressure within the first cavity sufficient to break any remaining seal and causing the hot gases to leak into said second cavity through said at least one internal vent holes and mix with the signature powder material, and building up enough pressure to expel the external vent plug and causing exhaustion of the contents through the external vent hole.

In one embodiment, the proprietary training cartridge replaces a LW30mm M788 TP Cartridge.

In one embodiment, the M788 projectile has an aluminum projectile nose that is replaced with translucent polycarbonate.

In one embodiment, only a portion of the M788 projectile aluminum is replaced with translucent polycarbonate such that the actual nose remains aluminum, but the immediately adjacent sidewalls are translucent allowing a flash to be visible.

In one embodiment, the M788 projectile is further modified in its interior to provide a flash cavity wherein there is a hollow chamber comprising a fuel such as magnesium powder or magnesium wool, or other brightly burning material, an oxidizer such as such as gaseous oxygen or potassium perchlorate, a spark producing mechanism such as a piece of flint with sandpaper or rough steel that, upon impact, the inertial force cause the spark to be formed, igniting the magnesium, producing the flash which is immediately visible through the translucent walls. In this embodiment, the combustion will also produce a hot gas buildup of pressure within the cavity which will rupture a seal allowing the hot gas to mix with a powdered signature material contained in the base of the projectile that further comprises a vent hole with a plug and as the pressure builds sufficiently, the plug will expel releasing the gas pressure buildup now mixed with the signature powder such as talc or titanium dioxide to produce a puff of 'smoke'. The bright flash, hot gases, and powdered signature material simulate the signature of the real combat cartridge, with a reduced noise signature.

In one embodiment, the foregoing description could modify a 40 mm M918 target practice cartridge. In an alternative embodiment, the modification described could be applied to a 40 mm M781 round.

In one embodiment, the flash ignition could utilize a primer and a striker, similar to those utilized in camera flash bulbs, (for example, as utilized in the brand MAGICUBE®).

In one embodiment, the flash ignition could comprise a piezoelectrical element that generates a spark upon impact.

In one embodiment. the foregoing general principles could be applied to w wide variety of applications, including 30 mm, 40 mm, 57 mm, and other calibers of conventional ammunition, as well as mortars, rockets, bombs, hand grenades, mines, and other artillery.

DETAILED DESCRIPTION

For clarity of disclosure, and not by way of limitation, the detailed description of the invention is divided into the following subsections that describe or illustrate certain features, embodiments or applications of the present invention.

The System and Method of the Present Invention

The present disclosure teaches embodiments of a realistically acting training ammunition round that produces a flash and smoke signature substantially similar to the actual round that it replaces for training.

Figure 1:
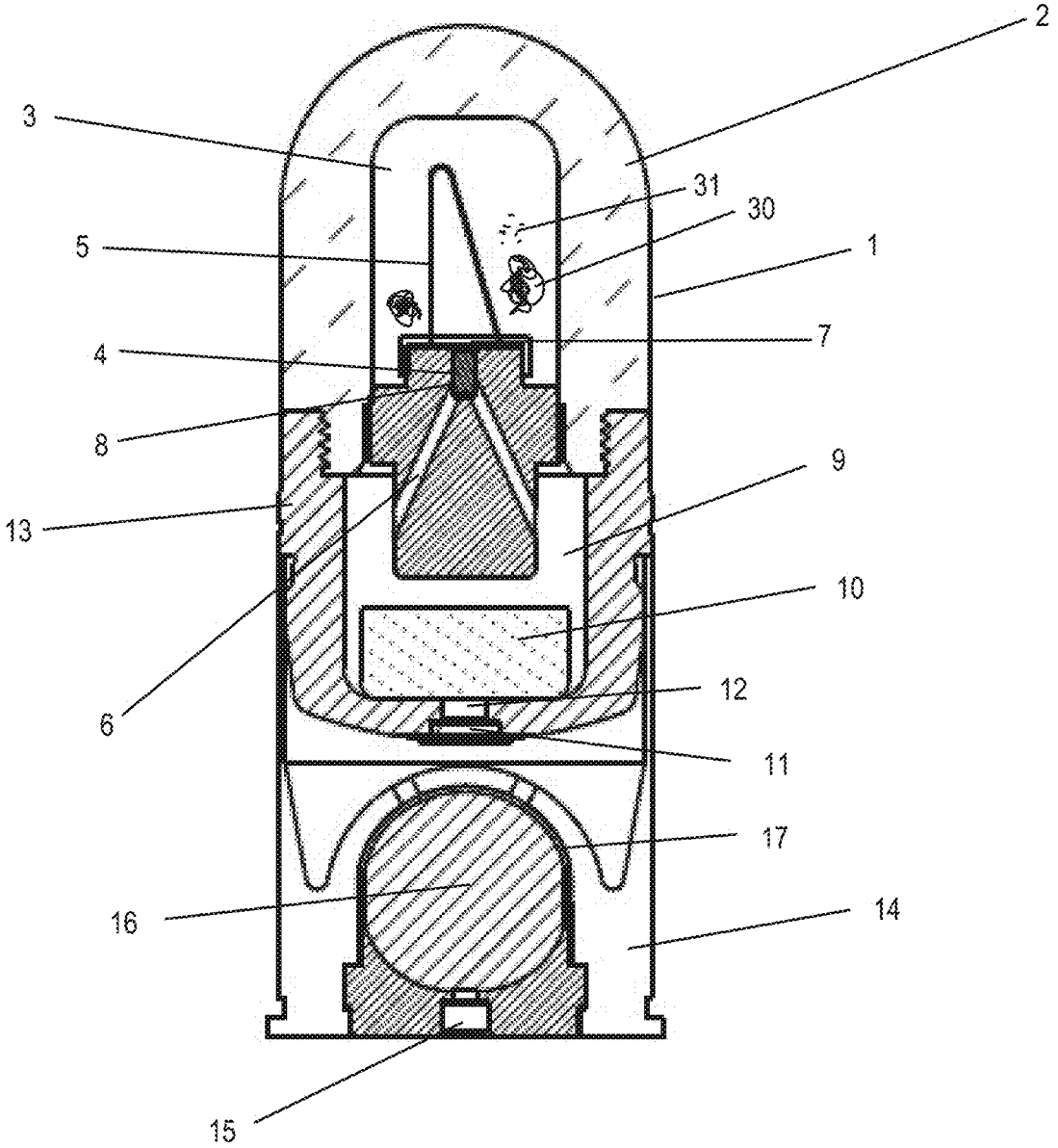
FIG. 1 depicts a cross sectional view of one embodiment of a modified training round cartridge as described herein and as mounted on a firing charge cartridge case.

In one embodiment, referring to FIG. 1, the projectile body (1) of a typical ammunition round is modified with a translucent ogive (2) and a first internal cavity (3) wherein the said first internal cavity is configured to comprise a flash producing mechanism comprising a flint (4), that through a sudden change in inertial force that is produced upon impact, pierces through a foil seal (7) and then against sandpaper or a rough steel (5) to produce a spark that will ignite the fuel/oxidizer mixture, which could be magnesium powder or wool (30) and potassium perchlorate (31), existing loose in the cavity (3), respectively, and upon ignition, creates a flash that is immediately visible through the translucent ogive (2). In this embodiment, the burning of the flash mechanism produces a buildup of hot gases that expel through the ruptured seal (7) and through vent holes (6) and into a separate second rear end cavity (9) housing a signature powder material (10) which could be titanium dioxide is accessed, the hot gases mixing then with the signature powder and the excess pressure expels a plug (11) blocking an external vent hole (12) and upon the unblocking, the signature powder is expelled through the now unblocked vent hole creating a simulation of smoke. FIG. 1 further illustrates the same projectile body sidewalls (13) as a normal live round munition that this modified training round replaces, configured to exactly fit the same into the cartridge case (14), that has the same closing cup (17) propellant charge (16) and rifle/pistol primer (15) as a live round such that it will work exactly the same with the weapon with which it is to be used. The flint (4) is housed in a compartment (8) that is connected to the vent holes (6) and once the flint ruptures the foil seal, the compartment (8) forms part of the entryway into the vent holes (6).

Figure 10:
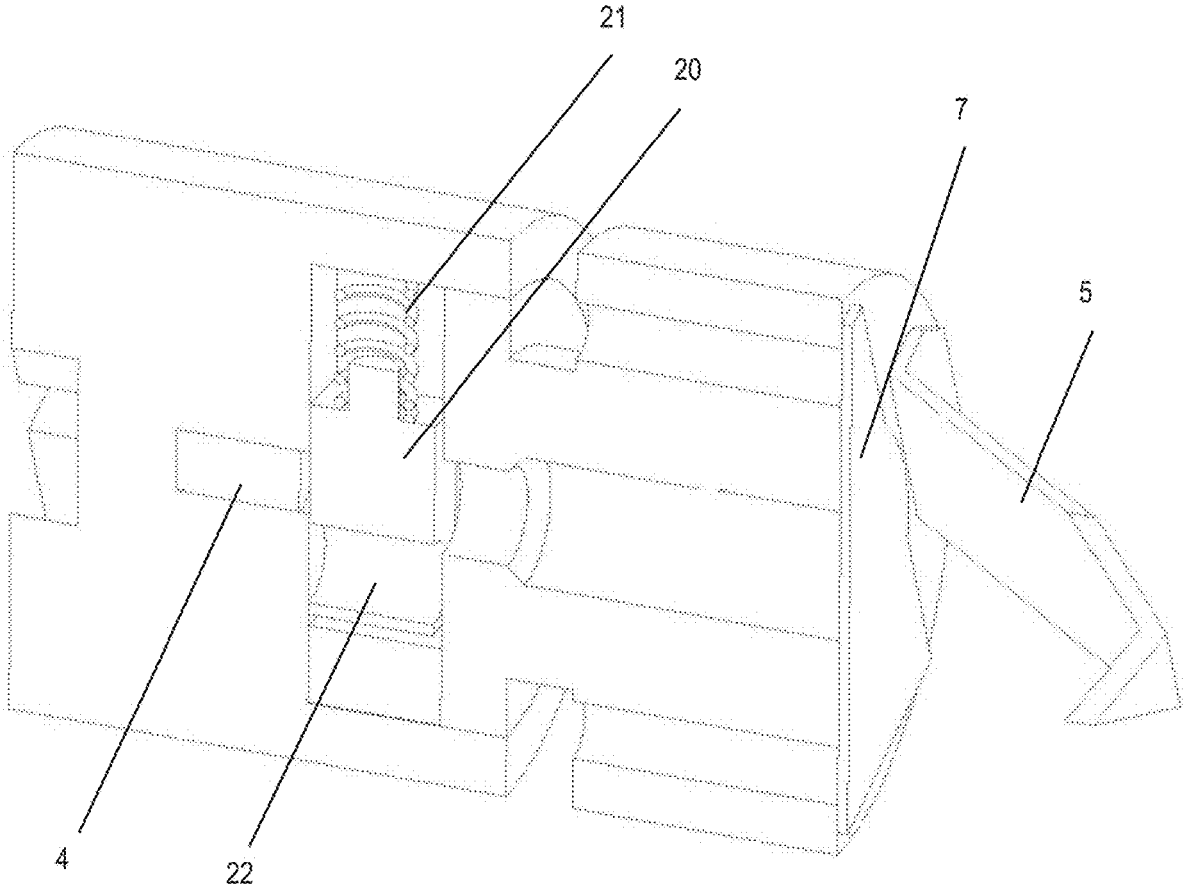
FIG. 10 depicts a cutaway view of one embodiment of the internal component that replaces the insides of a combat training round further depicting one embodiment of a flint ready in place to be deployed through a slider mechanism, said slider mechanism in the ready state keeping the flint secured in place.
Figure 11:
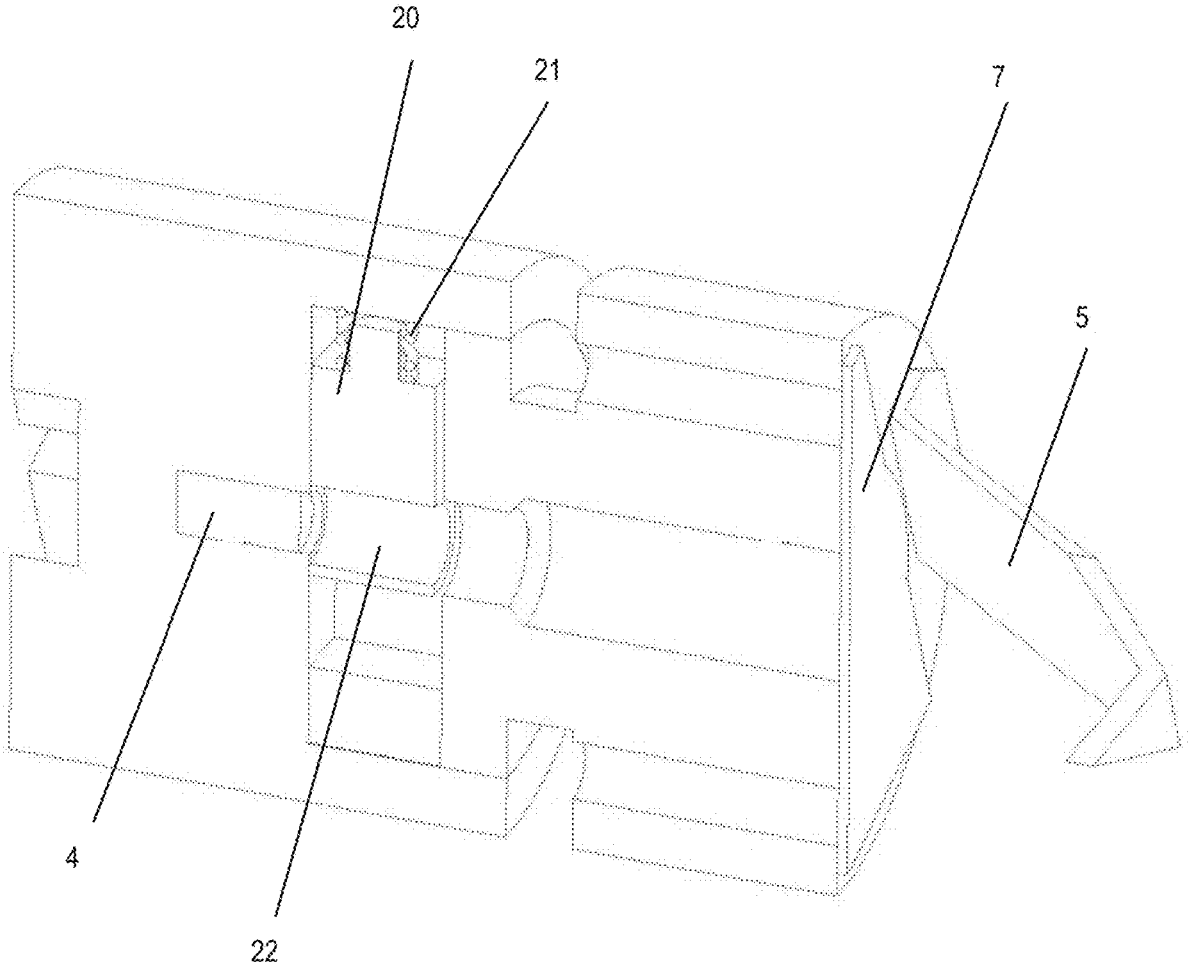
FIG. 11 depicts a cutaway view of one embodiment of the internal component that replaces the insides of a combat training round further depicting one embodiment of a flint ready in place to be deployed through a slider mechanism, said slider mechanism as it would appear once the projectile is fired and spins creating a centrifugal force compressing the spring and moving the slider such that the opening is exposed.
Figure 12:
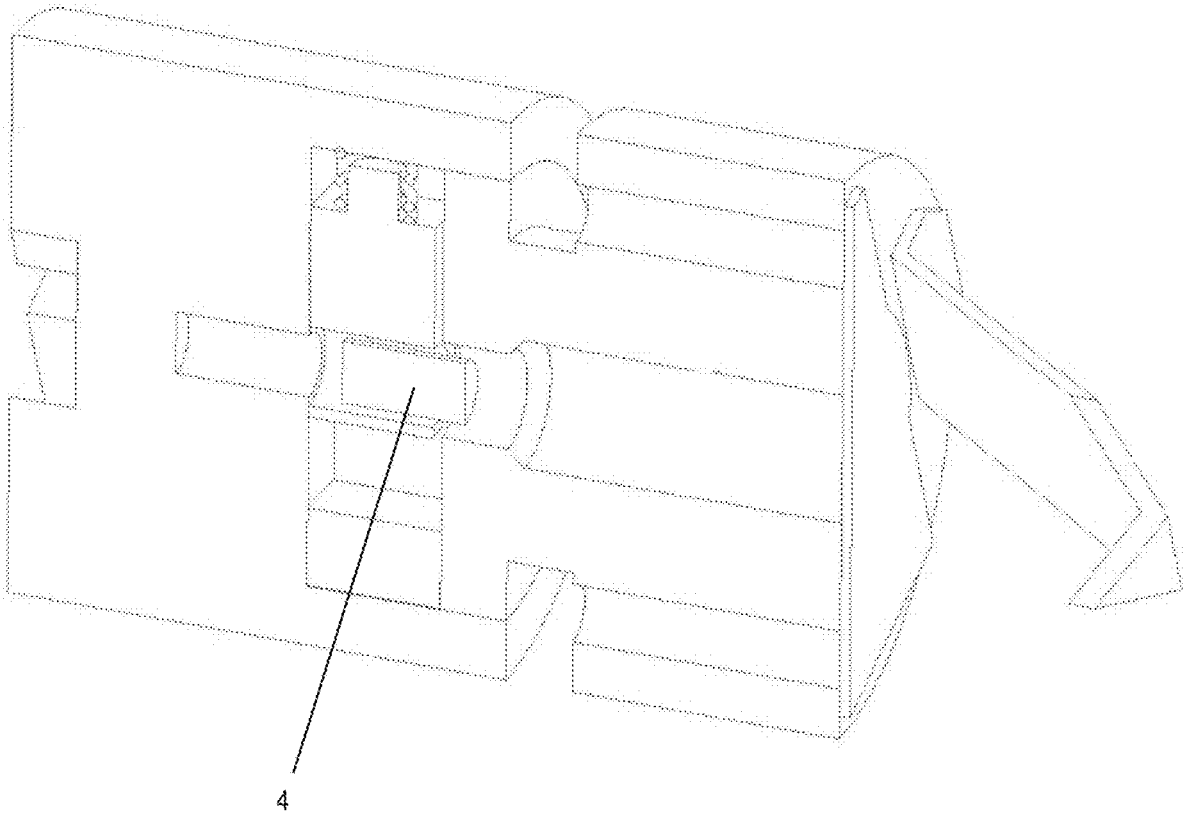
FIG. 12 depicts a cutaway view of one embodiment of the internal component that replaces the insides of a combat training round further depicting one embodiment of a flint now beginning to move through the opening portion of the slider mechanism via momentum force once the projectile impacts its target.
Figure 13:
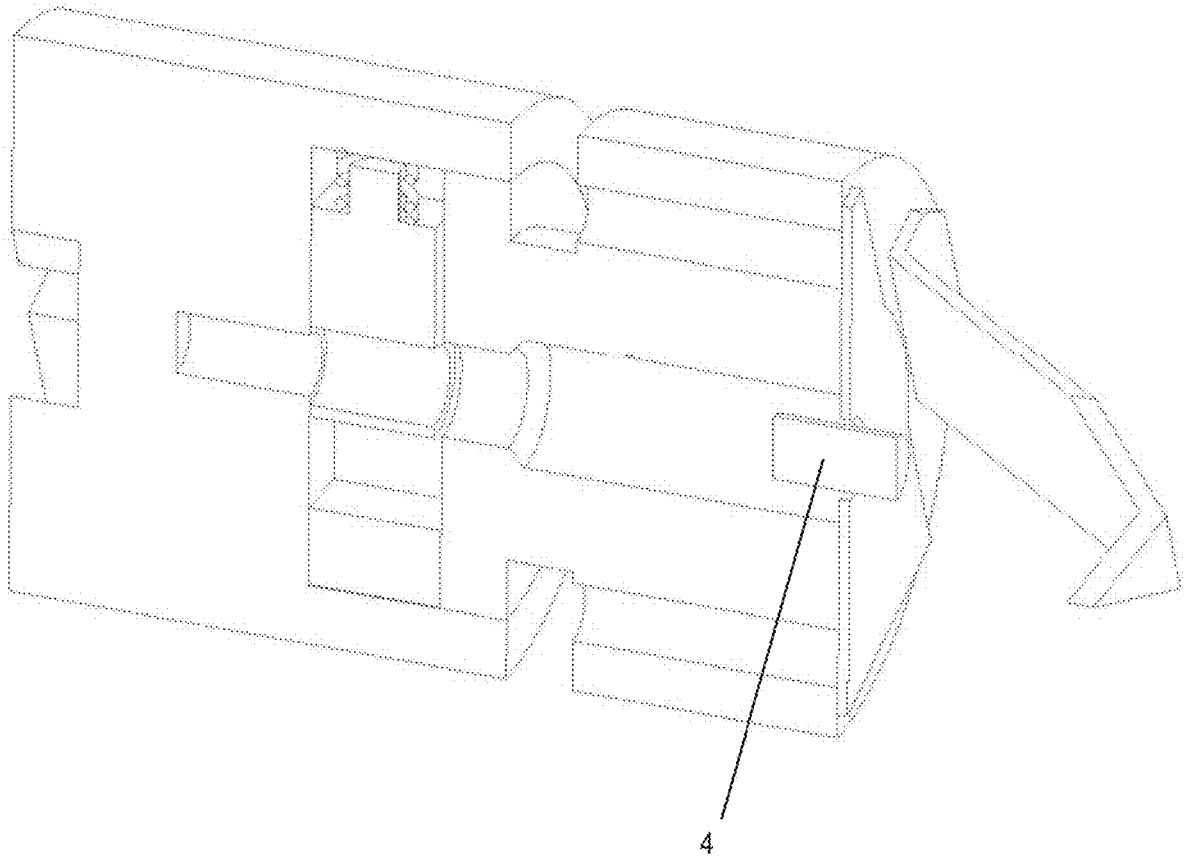
FIG. 13 depicts a cutaway view of one embodiment of the internal component that replaces the insides of a combat training round further depicting one embodiment of a flint as it continues to move forward and now breaks the foil seal allowing it into the chamber where the fuel, oxidizer and strike surface are housed.
Figure 14:
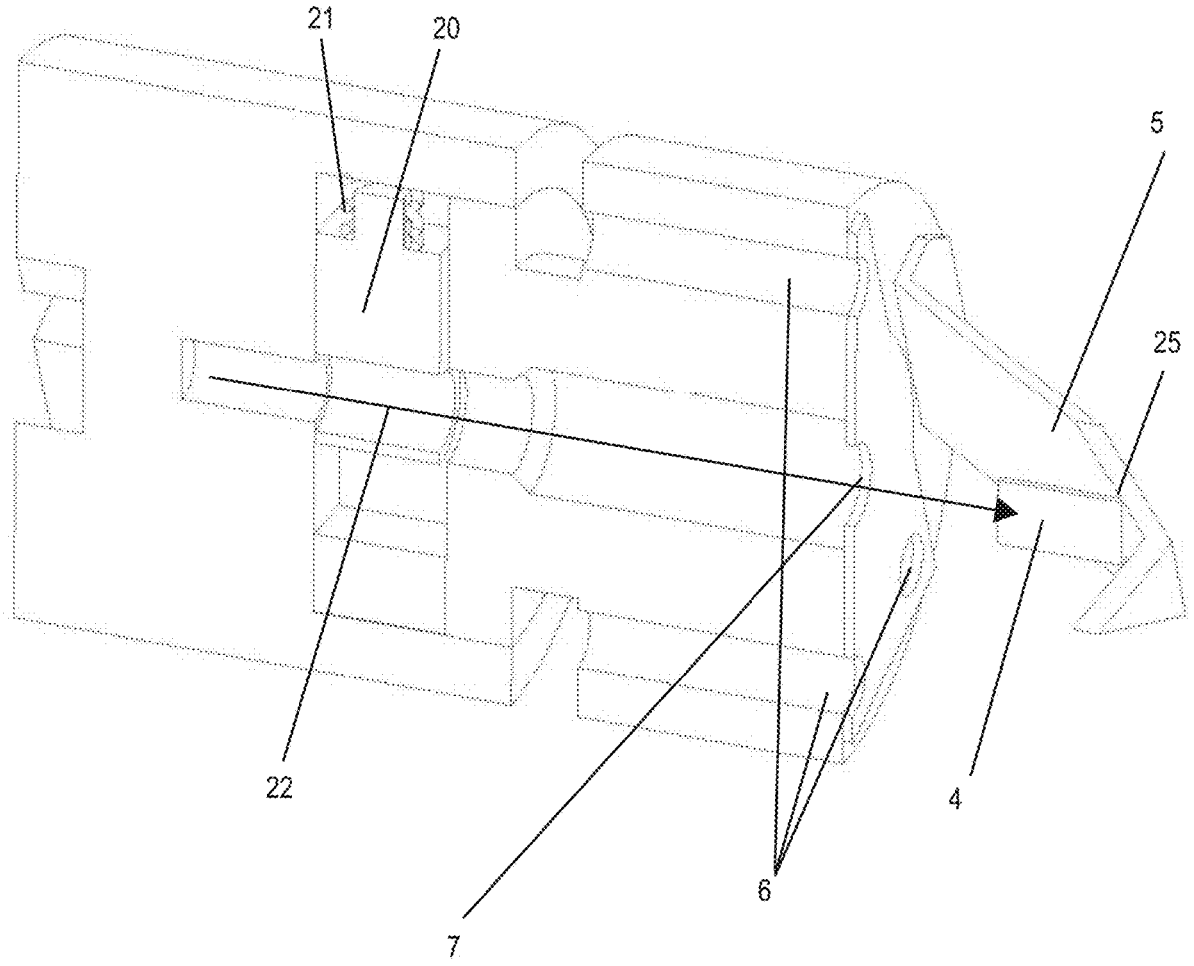
FIG. 14 depicts a cutaway view of one embodiment of the internal component that replaces the insides of a combat training round further depicting one embodiment of a flint as it continues to move forward and has broken through the seal and into the chamber where the fuel, oxidizer and strike surface are housed and striking the strike surface and creating a spark.

In alternative embodiment, referring to FIG. 10, which shows just the internal component housed within the cavities that generates the spark ignition, the flint (4) is housed in a lower compartment blocked by a slider bar (20) that comprises a spring (21) and a through hole (22) such that when rifling spin in the barrel of the weapon causes the projectile to spin, the spring compresses and the slider bar moves aligning the through hole (22) allowing the flint to escape and upon impact pierces through the seal (7) causing a hole and allowing the flint to strike the sandpaper (5) causing a spark to form at a point of impact (25). See, FIGS. 11-14. Now, in this embodiment, when the pressure builds from the gaseous ignition, the pressure also pierces the seal in the location of the vent holes (6) into the chamber with the signature powder.

Figure 15:
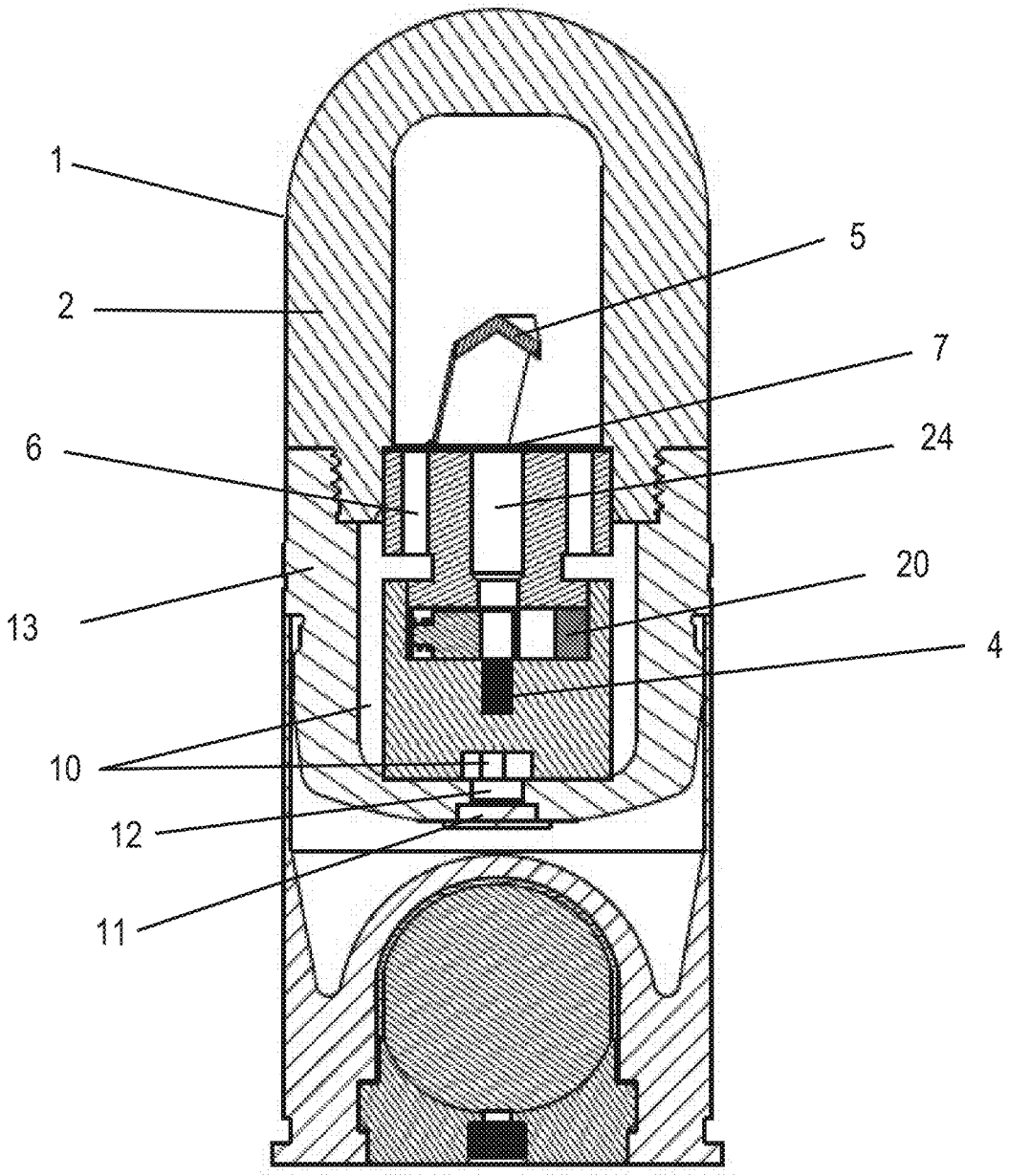
FIG. 15 depicts a cross sectional view of one embodiment of a modified training round cartridge as described herein and as mounted on a firing charge cartridge case depicting a slider activation mechanism.

In an alternative embodiment, referring to FIG. 15, the projectile body (1) of a typical ammunition round is modified with a translucent ogive (2) and is shown with the slider activation mechanism, but could also be further configured as shown in FIG. 1.

Figure 16:
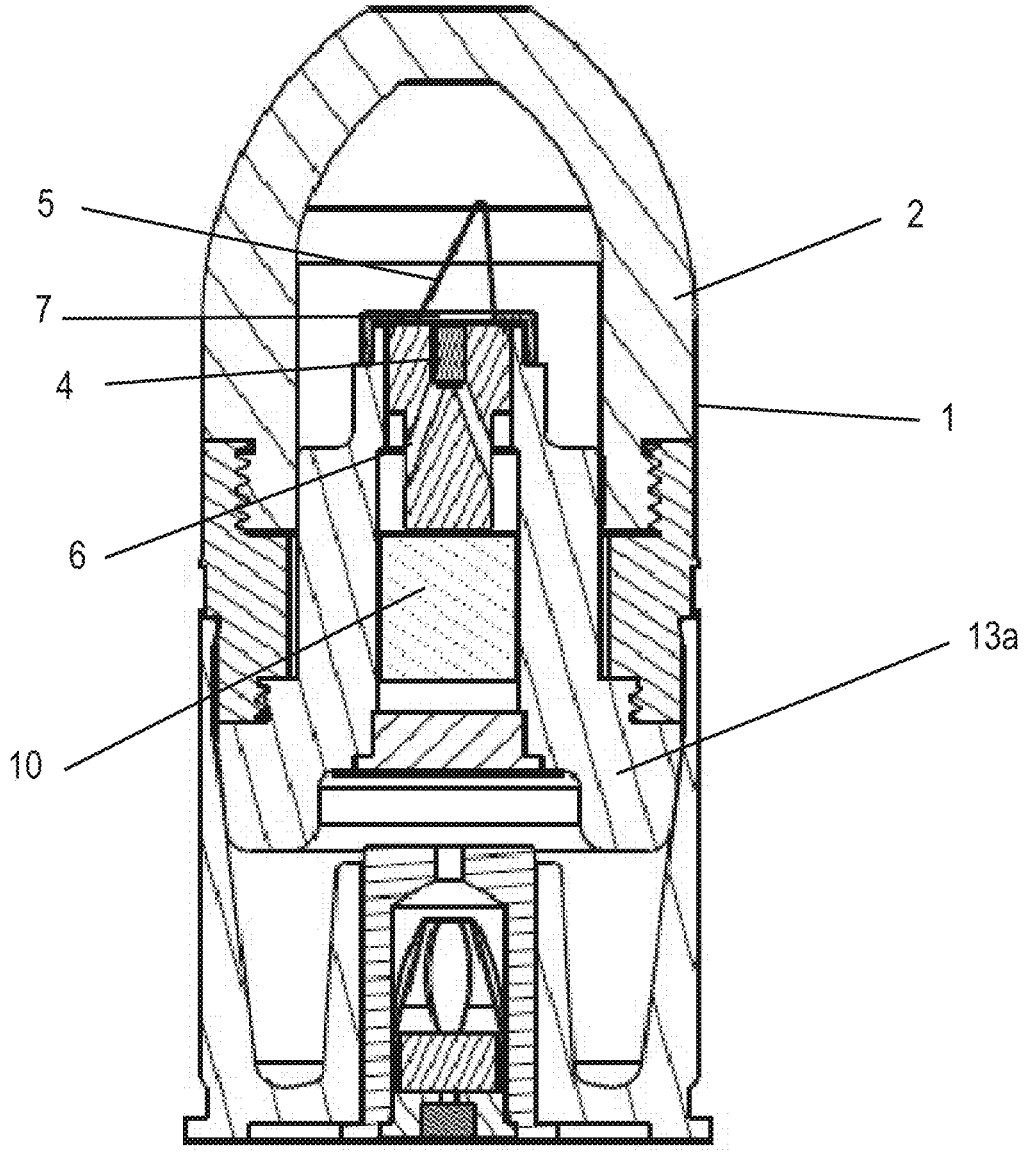
FIG. 16 depicts a cross sectional view of one embodiment of a modified training round cartridge as described herein and as mounted on a firing charge cartridge case depicting both a translucent ogive and a translucent projectile base and sidewalls.

In an alternative embodiment, referring to FIG. 16, the projectile body (1) of a typical ammunition round is modified with a translucent ogive (2) and a translucent base and sidewalls (13*a*) that replace the same projectile body sidewalls (13) as a normal live round munition it replaces. This configuration could combine with any of the alternative other embodiments described herein. In this FIG. 16, the configuration is shown with a low velocity, 40 mm, cartridge case. This configuration is pre-existing and needs no description, but is illustrative of the types of rounds that may be modified as taught herein.

Figure 2:
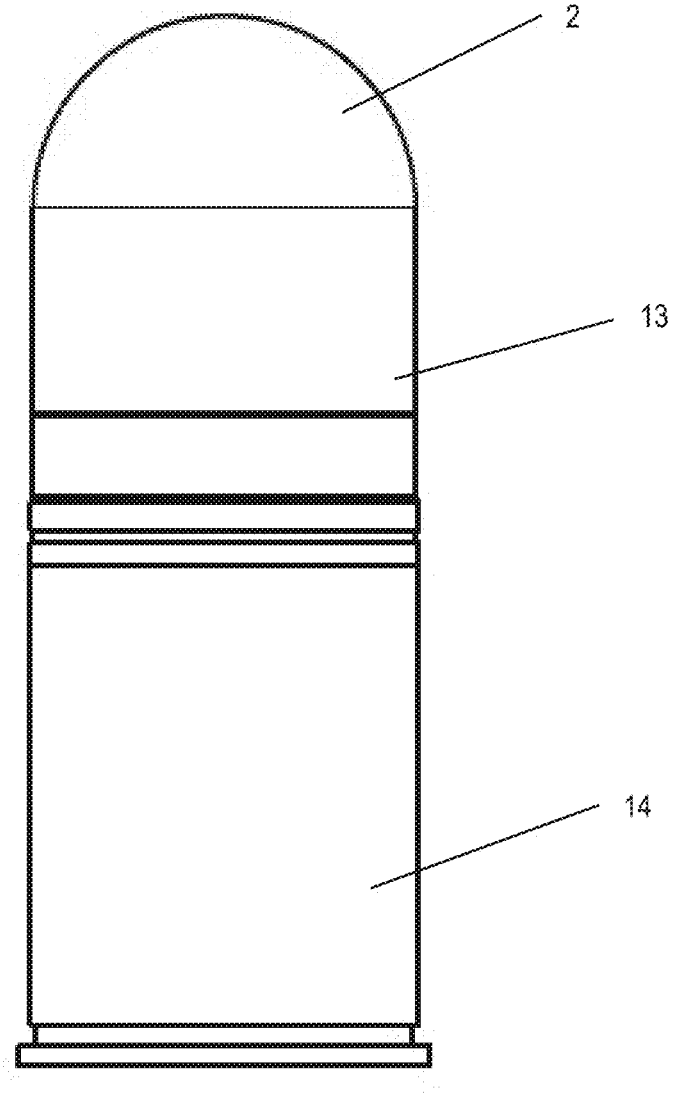
FIG. 2 depicts an outer side view of one embodiment of a modified training round cartridge as described herein and as mounted on a firing charge cartridge case.

In one embodiment, referring to FIG. 2, the outside of the projectile as modified as described herein looks and acts just like a live round with the one exception that the ogive (2) will have a translucent or transparent appearance, at least at some portion of it.

Figure 3:
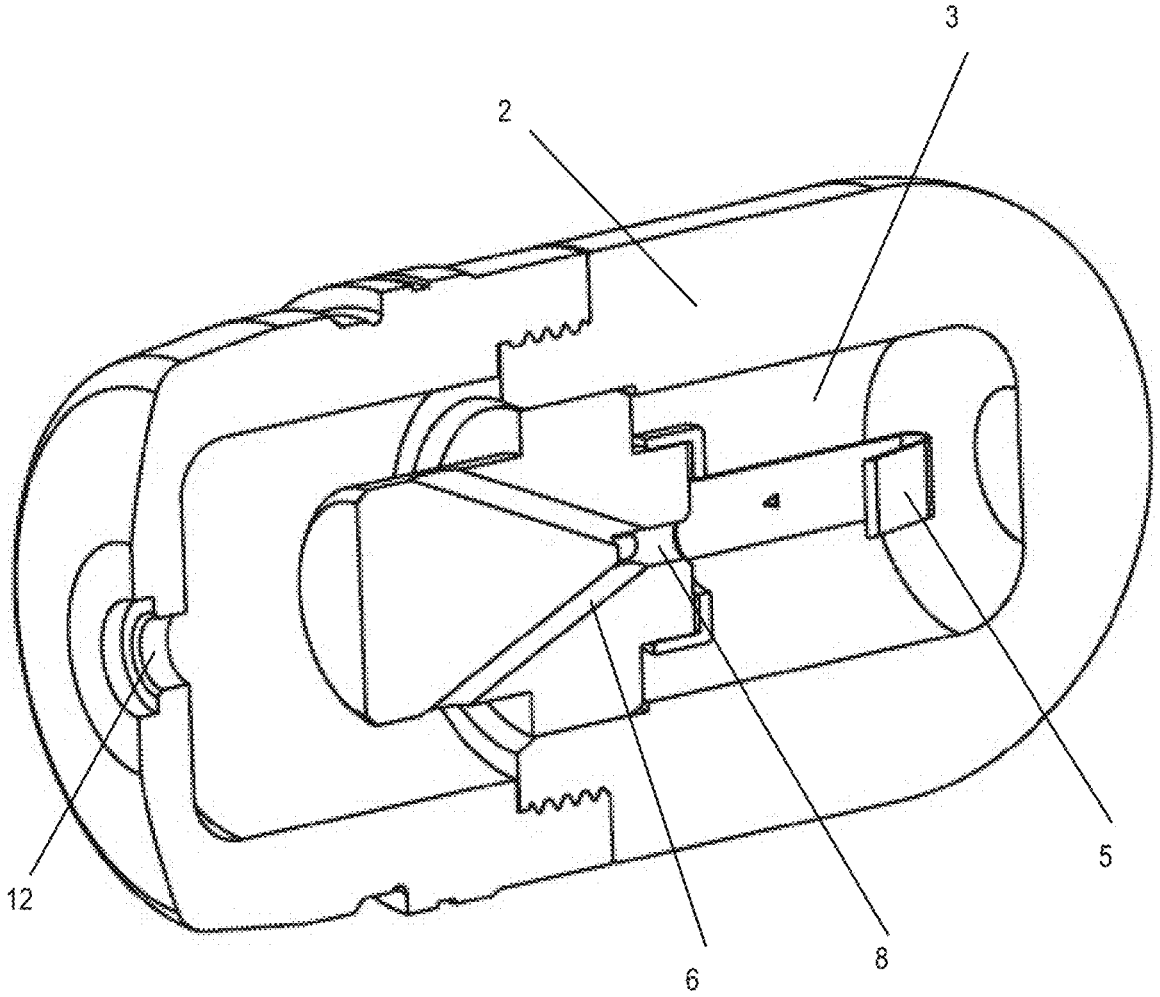
FIG. 3 depicts a cross sectional perspective view of one embodiment of a modified training round cartridge as described herein with its plug expelled.

In one embodiment, referring to FIG. 3, a spent cartridge as modified as described herein will have an exposed vent hole (12) with the flash mechanism components and signature powder material having been expelled, an exposed compartment (8) where the flint was leading to the vent holes (6).

Figure 4:
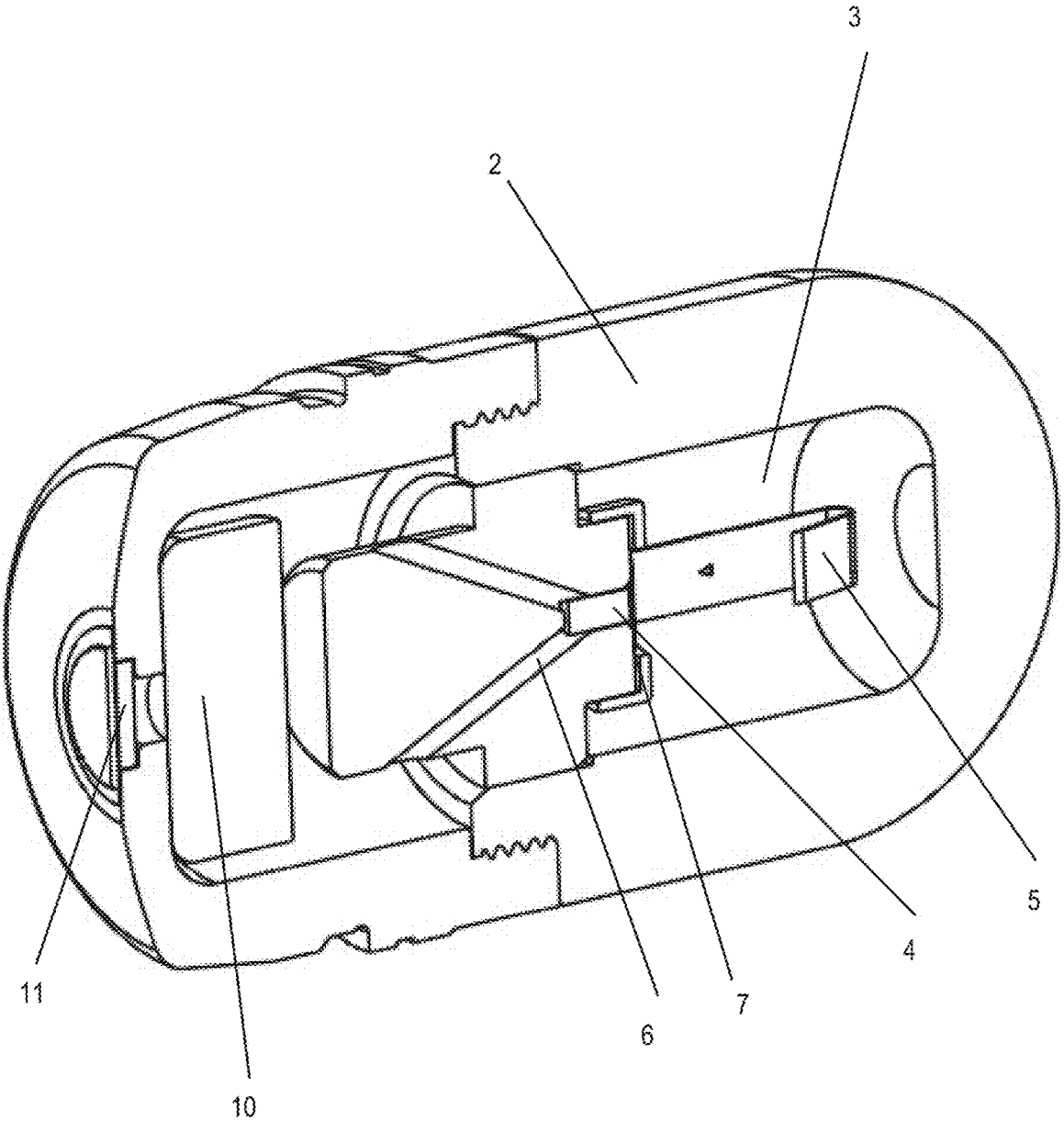
FIG. 4 depicts a cross sectional perspective view of one embodiment of a modified training round cartridge as described herein with its plug intact and a chamber of signature powder ready to be deployed.

In one embodiment, referring to FIG. 4, a non-used cartridge as modified as described herein will have its vent hole plugged (11) with the flash mechanism components and signature powder material intact.

Figure 5:
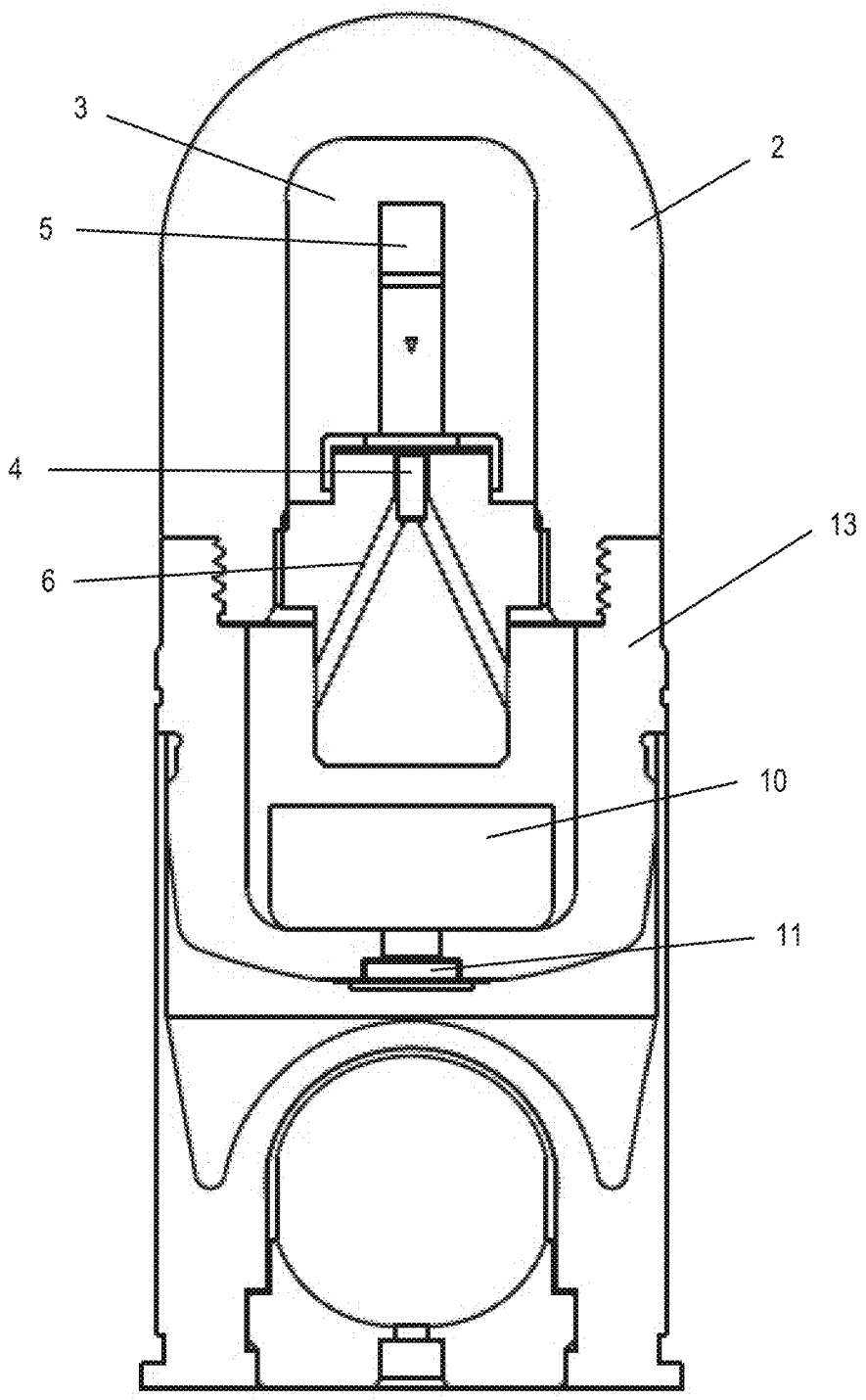
FIG. 5 depicts a cross sectional side view of one embodiment of a modified training round cartridge as described herein with its plug and signature powder intact and ready to be deployed and as mounted on a firing charge cartridge case.

In one embodiment, referring to FIG. 5, a cross section of a non-used cartridge as described herein is depicted mounted on a normal cartridge case ready for deployment.

Figure 6:
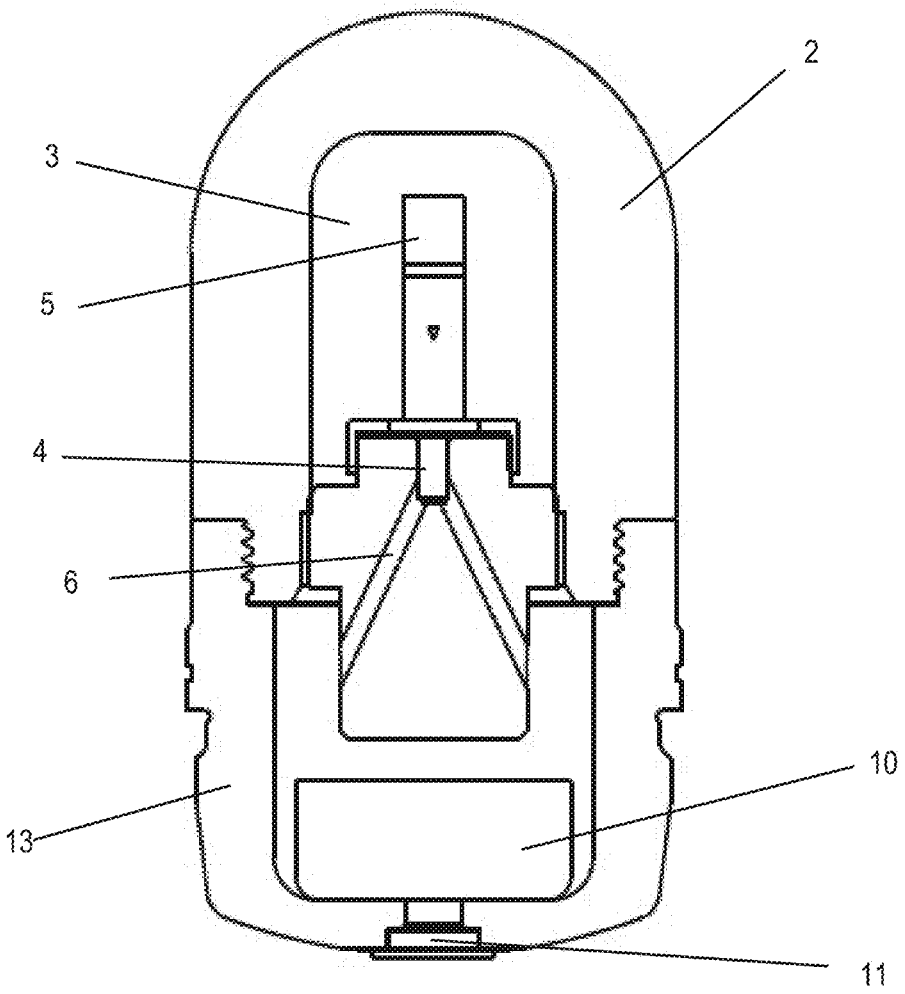
FIG. 6 depicts a cross sectional side view of one embodiment of a modified training round cartridge as described herein with its plug and signature powder intact and ready to be deployed.

In one embodiment, referring to FIG. 6, a non-used cartridge as modified as described herein will have its vent hole plugged (11) with the flash mechanism components and signature powder material intact.

Figure 7:
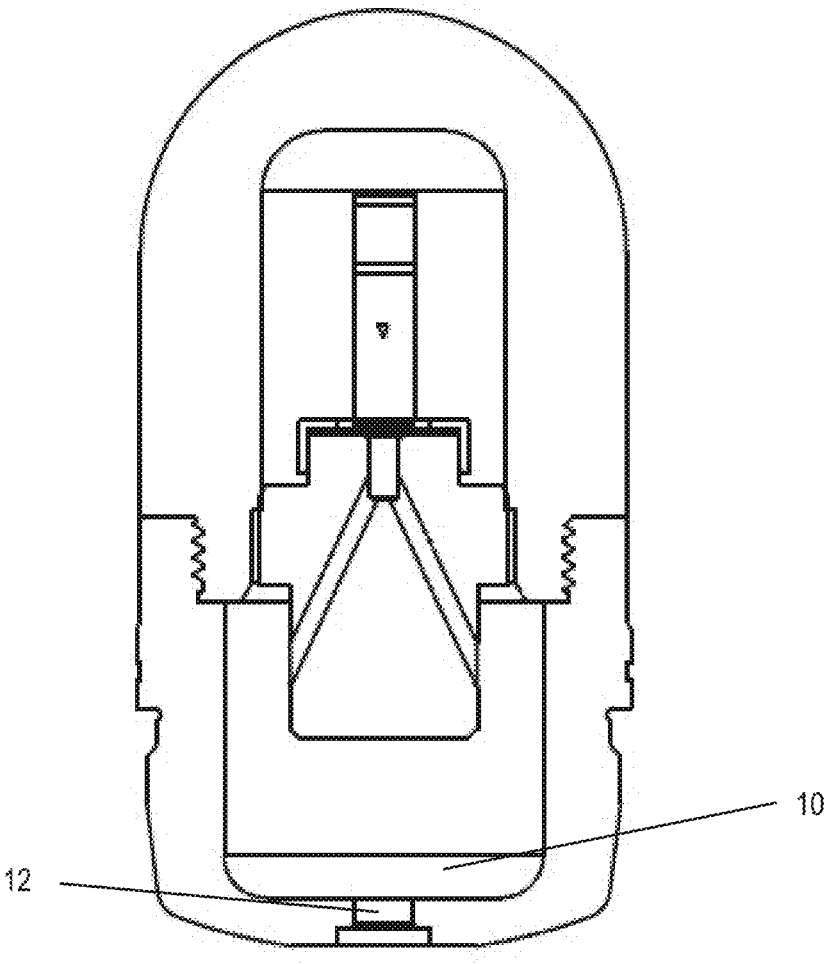
FIG. 7 depicts a cross sectional side view of one embodiment of a modified training round cartridge as described herein with its plug expelled and signature powder spent as after deployment.

In one embodiment, referring to FIG. 7, a spent cartridge as modified as described herein will have an exposed vent hole (12) with the flash mechanism components and signature powder material having been expelled.

Figure 8:
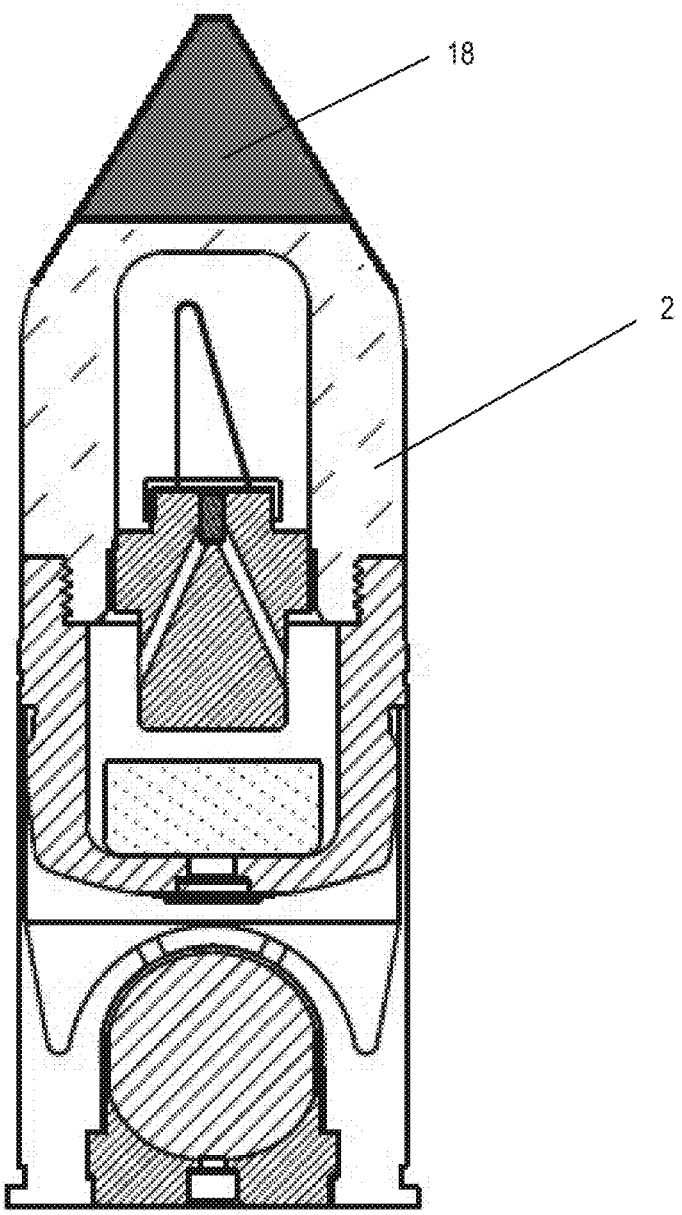
FIG. 8 depicts a cross sectional side view of one embodiment of a modified training round cartridge as described herein with its plug and signature powder intact and ready to be deployed and as mounted on a firing charge cartridge case. In this embodiment, the tip is metal with adjacent translucent sidewalls forming the forward ogive.
Figure 9:
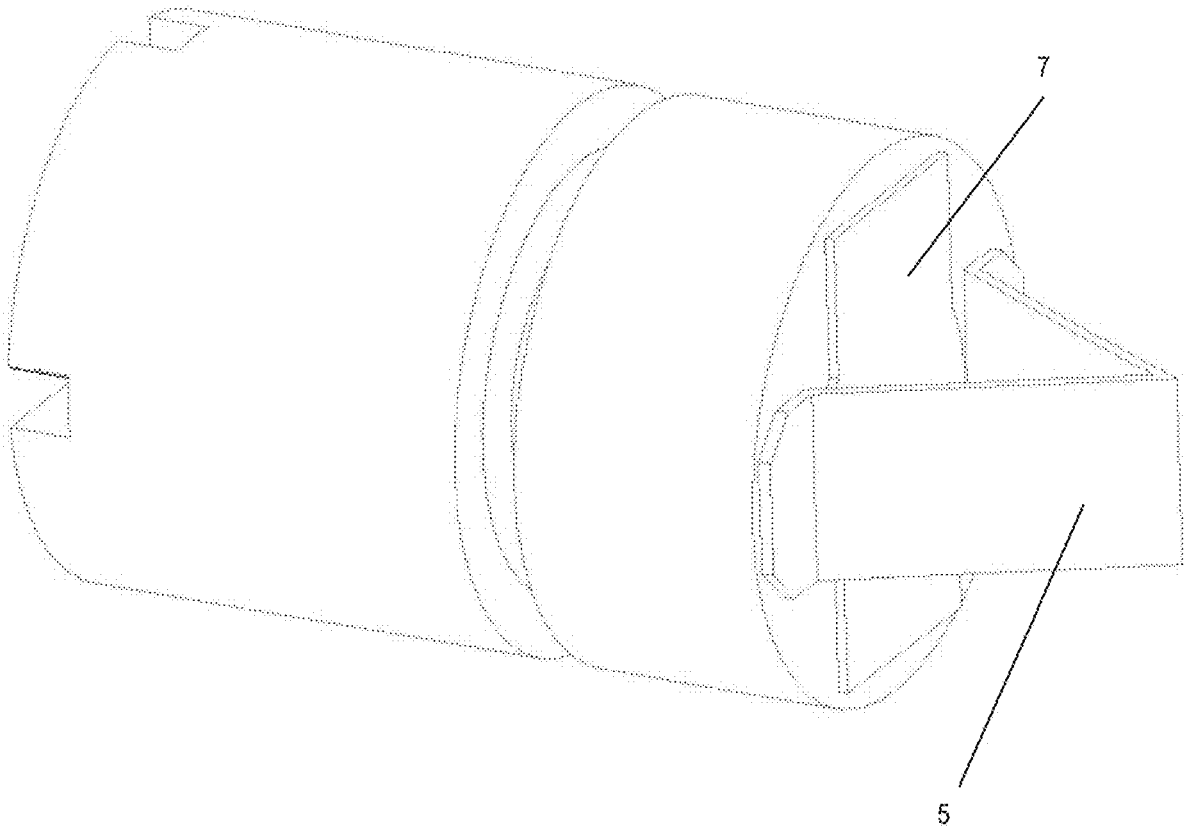
FIG. 9 depicts a perspective view of one embodiment of the internal component that replaces the insides of a combat training round that houses the other components as described herein.

In an alternative embodiment, referring to FIG. 8, an ogive (2) may have a translucent component with a normal metal tip (18).

In one embodiment, the flint (4) is secured in place in a compartment (8) just beneath a thin metal foil seal (7), such as aluminum foil, that secures the flint until the projectile impacts a target when the inertial force is sufficient to rupture the thin metal foil seal, striking the flint against the sandpaper or a rough steel component causing a spark to ignite the flash procuring materials that are loose within the cavity (3). In this embodiment, the seal also prevents the flash producing material from accumulating in the flint compartment or leaking through the vent holes (6) and keeps everything in place until impact. The one potential issue with this arrangement is that dropping the projectile prior to use may be sufficient impact to cause the flint to rupture the seal and cause a premature leaking of flash producing materials. Dropping the projectile may also be sufficient to dislodge the flint either prematurely causing a spark or causing the flint to be incapable of causing a spark.

In an alternative embodiment, a slider mechanism is utilized to keep the flint in place. In this embodiment, referring to FIGS. 10-14, a simple bar (20) with a hole in it (22), is biased to block the flint with a spring (21) is set in place. Upon firing, spin causes the slider to move via centrifugal force compressing the spring and aligning the hole in the bar with the flint, essentially arming the flash mechanism that is then activated upon impact as described above. In this embodiment, the projectile can survive much greater drop test than the metal foil seal arrangement.

In one embodiment, the ogive as described herein is at least partially constructed from polycarbonate that is transparent or at least translucent.

In one embodiment, the entire projectile outer shell may be comprised of polycarbonate and be completely translucent maximizing visibility of the flash under many conditions.

In one embodiment, the flash generating material components comprise magnesium powder and gaseous oxygen.

In one embodiment, the flash generating material components comprise magnesium wool and gaseous oxygen.

In one embodiment, the flash generating material components comprise magnesium powder and potassium perchlorate.

In one embodiment, the flash generating material components comprise magnesium wool and potassium perchlorate.

In one embodiment, the ogive portion of the projectile is completely translucent or transparent and constructed from polycarbonate.

In one embodiment, the ogive portion of the projectile is partially translucent or transparent and constructed from polycarbonate with an aluminum nose. In an alternative embodiment, the aluminum nose can be replaced and constructed with any suitable metal chosen for strength, weight, deformation, and other desirable properties.

In one embodiment, the overall working order of events is the firing pin strikes the primer, initiating the primer. The primer ignites the propellant charge. Expanding propellant gases accelerate the projectile spinning down the length of the barrel and causing the projectile to spin within the barrel. Projectile spin causes the slider to overcome the slider spring force, moving the slider to the armed position. Upon target impact, rapid projectile deceleration causes the flint to be thrust forward and pierce a foil seal and exit the flint cavity. The flint strikes the sandpaper, creating a spark that ignites the magnesium powder and potassium perchlorate mixture. The resulting chemical reaction produces a bright flash and a small volume of hot, modest pressure gases. These hot gases rupture a seal (and/or expel through the break in the seal caused by the flint puncture) and vent into the base of the projectile where it mixes with a powdered signature material such as titanium dioxide or talc. This mixture of warm, mildly pressurized gas and powder forces the base plug out of the projectile base, allowing the warm gases and powder to flow out of the projectile. The bright flash, powdered signature material, and warm gases produce a signature that closely mimics the combat round when observed day or night with the naked eye or night vision equipment including image intensifiers and thermal imagers. The bright flash, warm gases and powdered signature material minimize the hazards associated with projectiles that do not function upon target impact (duds).

In alternative embodiments, ignition mechanisms may include projectiles where the sandpaper is replaced with a piezo element and a simple impactor mass such as a steel rod replaces the flint. The piezo element produces a spark when struck by the impactor mass. In another example, an ignition mechanism replaces the sand paper with a primer or primer compound or similar sensitive material in the forward end of the flash cavity, and a firing pin replaces the flint. Upon target impact, the firing pin strikes the primer, igniting the flash. One of skill in the art will be well versed in the choice of fuels, oxidizers and the like while maintaining the basic principles as described herein.

Publications cited throughout this document are hereby incorporated by reference in their entirety. Although the various aspects of the invention have been illustrated above by reference to examples and preferred embodiments, it will be appreciated that the scope of the invention is defined not by the foregoing description but by the following claims properly construed under principles of patent law.

Each and every feature described herein, and each and every combination of two or more of such features, is included within the scope of the present invention provided that the features included in such a combination are not mutually exclusive.

What is claimed is:

1. A training ammunition round comprising:

a training cartridge casing identical to a combat cartridge casing of an ammunition round which the training cartridge case is designed to replace for training, comprising a primer and a propellant charge;

a projectile body comprising a first base end that is configured to seat within the training cartridge casing and a second opposite front end configured to be at least partially translucent and comprise a first and second cavity;

said first cavity containing a combustible flash producing material, an oxidizer, and a first spark producing component, said second cavity containing a predetermined amount of a signature powder material, an external vent hole and an external vent hole plug, wherein there is a solid area between said first cavity and said second cavity, the solid area comprising at least one internal vent hole, and a second spark producing component capable of producing a spark when meeting with the first spark producing component, the second spark producing component is housed in a compartment exposed to the first cavity and, the compartment is covered with a seal;

the training cartridge casing is configured to produce a spark upon the second spark producing component breaking said seal and striking said first spark producing component, the spark ignites the combustible flash producing material whereupon a flash occurs and a hot gaseous pressure builds up to a pre-determined pressure within the first cavity sufficient to break any remaining seal and causes the hot gases to leak into said second cavity through said at least one internal vent holes, the hot gases mix with the signature powder material, and build up enough pressure to expel the external vent plug and cause exhaustion of the contents through the external vent hole.

2. The device of claim 1 wherein the training ammunition round replaces a live round from the group: M788, M918, and M781 TP Cartridge.

3. The device of claim 1 wherein said second opposite front end of said projectile body comprises and ogive that is fully translucent.

4. The device of claim 1 wherein said combustible flash producing material is magnesium powder.

5. The device of claim 1 wherein said combustible flash producing material is magnesium wool.

6. The device of claim 1 wherein said oxidizer is potassium perchlorate.

7. The device of claim 1 wherein said oxidizer is oxygen.

8. The device of claim 1 wherein said signature powder is titanium dioxide.

9. The device of claim 1 wherein said signature powder is talc.

10. The device of claim 1 wherein the second opposite front end of said projectile body comprises an ogive that is partially translucent with a non-translucent metal nose.

11. A training ammunition round comprising:

a training cartridge casing identical to a combat cartridge casing of an ammunition round which the training cartridge casing is designed to replace for training, comprising a primer and a propellant charge;

a projectile body comprising a first base end that is configured to seat within the training cartridge casing and a second opposite front end configured to be at least partially translucent and comprise a first and second cavity;

said first cavity containing a combustible flash producing material, an oxidizer, and a first spark producing component, said second cavity containing a predetermined amount of a signature powder material, an external vent hole and an external vent hole plug, wherein there is a solid area between said first cavity and said second cavity, the solid area comprising at least one internal vent hole, and a second spark producing component capable of producing a spark when meeting with the first spark producing component, the second spark producing component is housed in a compartment separated from said first cavity along a hollow pathway which is covered with a seal and blocked by a spring actuated slider bar comprising a channel configured to align with said hollow pathway when sufficient force is generated to compress the spring;

the training cartridge casing is configured to produce a spark upon the second spark producing component breaking said seal and striking said first spark producing component, the spark ignites the combustible flash producing material whereupon a flash occurs and a hot gaseous pressure builds up to a pre-determined pressure within the first cavity sufficient to break any remaining seal and causes the hot gases to leak into said second cavity through said at least one internal vent holes, the hot gases mix with the signature powder material, and build up enough pressure to expel the external vent plug causing exhaustion of the contents through the external vent hole.

12. The device of claim 11 wherein said first spark producing component is chosen from the group comprising sandpaper, rough steel, a piezo element, and an ignition mechanism comprising a primer.

13. The device of claim 11 wherein said second spark producing component is chosen from the group comprising flint, steel rod, an impactor mass, and a firing pin.

* * * * *